US008118946B2

(12) United States Patent
Lau

(10) Patent No.: US 8,118,946 B2
(45) Date of Patent: Feb. 21, 2012

(54) CLEANING PROCESS RESIDUES FROM SUBSTRATE PROCESSING CHAMBER COMPONENTS

(76) Inventor: Wesley George Lau, San Jose, CA (US)

( * ) Notice: Subject to any disclaimer, the term of this patent is extended or adjusted under 35 U.S.C. 154(b) by 435 days.

(21) Appl. No.: 11/948,766

(22) Filed: Nov. 30, 2007

(65) Prior Publication Data

US 2009/0139540 A1 Jun. 4, 2009

(51) Int. Cl.
*B08B 7/00* (2006.01)
*B08B 7/04* (2006.01)

(52) U.S. Cl. ..... 134/30; 134/26; 134/1; 134/1.1; 134/22.12; 134/22.18

(58) Field of Classification Search ..... 134/1, 1.3, 134/22.1, 22.18, 22.19, 26, 30, 1.1, 22.12; 438/905
See application file for complete search history.

(56) References Cited

U.S. PATENT DOCUMENTS

| | | | |
|---|---|---|---|
| 4,282,267 | A | 8/1981 | Kuyel |
| 4,433,228 | A | 2/1984 | Nishimatsu et al. |
| 4,436,581 | A | 3/1984 | Okudaira et al. |
| 4,465,532 | A | 8/1984 | Fukano |
| 4,490,209 | A | 12/1984 | Hartman |
| 4,502,914 | A | 3/1985 | Trumpp et al. |
| 4,529,474 | A | 7/1985 | Fujiyama et al. |
| 4,576,692 | A | 3/1986 | Fukuta et al. |
| 4,705,595 | A | 11/1987 | Okudaira et al. |
| 4,738,748 | A | 4/1988 | Kisa |
| 4,786,352 | A | 11/1988 | Benzing |
| 4,799,991 | A | 1/1989 | Dockrey |
| 4,818,326 | A | 4/1989 | Liu et al. |
| 4,820,377 | A | 4/1989 | Davis et al. |
| RE32,928 | E | 5/1989 | Jacob |
| 4,831,963 | A | 5/1989 | Saito et al. |
| 4,863,561 | A | 9/1989 | Freeman et al. |
| 4,867,841 | A | 9/1989 | Loewenstein et al. |
| 4,876,212 | A | 10/1989 | Koury |
| 4,960,488 | A | 10/1990 | Law et al. |
| 4,975,144 | A | 12/1990 | Yamazaki et al. |
| 4,992,134 | A | 2/1991 | Gupta et al. |
| 4,992,136 | A | 2/1991 | Tachi et al. |
| 4,994,410 | A | 2/1991 | Sun et al. |
| 5,002,632 | A | 3/1991 | Loewenstein et al. |

(Continued)

FOREIGN PATENT DOCUMENTS

| | | |
|---|---|---|
| DE | 4132559 | 4/1993 |

(Continued)

OTHER PUBLICATIONS

Aydil, et al., "Multiple Steady States in a Radio Frequency Chlorine Glow Discharge", *J. Appl. Phys.*, vol. 69, No. 1, Jan. 1, 1991, p. 109-114.

(Continued)

*Primary Examiner* — Alexander Markoff
(74) *Attorney, Agent, or Firm* — Fox Rothschild LLP

(57) ABSTRACT

A component from a substrate processing chamber which has plasma process residues on both its internal and external surfaces, is removed from the processing chamber, and transferred to a cleaning chamber. The component is exposed to an energized cleaning gas in the cleaning chamber, and the cleaning gas is exhausted from below the component so that the cleaning gas cleans off the residues on both the internal and external surfaces of the component. It has been determined that the cleaning gas can also repair surface defects in the component.

24 Claims, 4 Drawing Sheets

U.S. PATENT DOCUMENTS 5,010,842 A 4/1991 Oda et al.
5,013,398 A 5/1991 Long et al.
5,035,768 A 7/1991 Mu et al.
5,084,126 A 1/1992 McKee
5,094,712 A 3/1992 Becker et al.
5,110,408 A 5/1992 Fujii et al.
5,110,411 A 5/1992 Long
5,118,387 A 6/1992 Kadomura
5,158,644 A 10/1992 Cheung et al.
5,160,407 A 11/1992 Latchford et al.
5,164,330 A 11/1992 Davis et al.
5,176,792 A 1/1993 Fullowan et al.
5,180,464 A 1/1993 Tatsumi et al.
5,188,980 A 2/1993 Lai
5,192,702 A 3/1993 Tseng
5,207,836 A 5/1993 Chang
5,219,485 A 6/1993 Wang et al.
5,256,245 A 10/1993 Keller et al.
5,259,923 A 11/1993 Hori et al.
5,281,302 A 1/1994 Gabric et al.
5,282,899 A 2/1994 Balmashonov et al.
5,312,519 A 5/1994 Sakai et al.
5,318,668 A 6/1994 Tamaki et al.
5,338,398 A 8/1994 Szwejkowski et al.
5,354,416 A 10/1994 Okudaira et al.
5,354,417 A 10/1994 Cheung et al.
5,356,478 A 10/1994 Chen et al.
5,358,601 A 10/1994 Cathey
5,376,228 A 12/1994 Yanagida
5,378,311 A 1/1995 Nagayama et al.
5,382,316 A 1/1995 Hills et al.
5,384,009 A 1/1995 Mak et al.
5,389,197 A 2/1995 Ishimaru
5,401,356 A 3/1995 Enami et al.
5,413,954 A 5/1995 Aydil et al.
5,417,826 A 5/1995 Blalock
5,431,772 A 7/1995 Babie et al.
5,443,686 A 8/1995 Jones et al.
5,445,712 A 8/1995 Yanagida
5,449,411 A 9/1995 Fukuda et al.
5,486,975 A 1/1996 Shamouilian et al.
5,514,622 A 5/1996 Bornstein et al.
5,521,119 A 5/1996 Chen et al.
5,529,197 A 6/1996 Grewal
5,585,012 A 12/1996 Wu et al.
5,605,601 A 2/1997 Kawasaki
5,620,615 A 4/1997 Keller
5,626,775 A 5/1997 Roberts et al.
5,637,237 A 6/1997 Oehrlein et al.
5,644,153 A 7/1997 Keller
5,647,953 A 7/1997 Williams et al.
5,651,856 A 7/1997 Keller et al.
5,676,759 A 10/1997 Ye et al.
5,677,228 A 10/1997 Tseng
5,700,741 A 12/1997 Liao
5,716,495 A 2/1998 Butterbaugh et al.
5,741,396 A 4/1998 Loewenstein
5,753,533 A 5/1998 Saito
5,756,400 A 5/1998 Ye et al.
5,767,021 A 6/1998 Imai et al.
5,772,770 A 6/1998 Suda et al.
5,788,778 A 8/1998 Shang et al.
5,788,799 A 8/1998 Steger et al.
5,811,022 A 9/1998 Savas et al.
5,817,534 A 10/1998 Ye et al.
5,817,578 A 10/1998 Ogawa et al.
5,843,239 A * 12/1998 Shrotriya ..... 134/1.1
5,846,373 A 12/1998 Pirkle et al.
5,849,092 A 12/1998 Xi et al.
5,861,233 A 1/1999 Sekine et al.
5,861,601 A 1/1999 Sato et al.
5,865,896 A 2/1999 Nowak et al.
5,866,483 A 2/1999 Shiau et al.
5,869,401 A 2/1999 Brunemeier et al.
5,874,363 A 2/1999 Hoh et al.
5,879,575 A 3/1999 Tepman et al.
5,882,424 A 3/1999 Taylor et al.
5,891,799 A 4/1999 Tsui
5,897,740 A 4/1999 Tamura
5,908,319 A 6/1999 Xu et al.
5,939,831 A 8/1999 Fong et al.
5,976,933 A 11/1999 Brambilla et al.
5,983,828 A 11/1999 Savas
6,001,538 A 12/1999 Chen et al.
6,003,526 A 12/1999 Lo et al.
6,014,979 A 1/2000 Van Autryve et al.
6,026,762 A 2/2000 Kao et al.
6,029,602 A 2/2000 Bhatnagar
6,039,834 A 3/2000 Tanaka et al.
6,045,618 A 4/2000 Raoux et al.
6,068,729 A 5/2000 Shrotriya
6,070,552 A 6/2000 Mizuno et al.
6,071,375 A 6/2000 Chen et al.
6,079,426 A 6/2000 Subrahmanyam et al.
6,085,690 A 7/2000 Mizuno
6,090,718 A 7/2000 Soga et al.
6,103,632 A 8/2000 Kumar et al.
6,108,929 A 8/2000 Kato et al.
6,124,927 A 9/2000 Zhong et al.
6,125,859 A 10/2000 Kao et al.
6,132,577 A 10/2000 Smith et al.
6,136,211 A 10/2000 Qian et al.
6,159,811 A 12/2000 Shin et al.
6,170,428 B1 1/2001 Redeker et al.
6,182,602 B1 2/2001 Redeker et al.
6,187,151 B1 2/2001 Leiphart
6,225,187 B1 5/2001 Huang et al.
6,270,634 B1 8/2001 Kumar et al.
6,274,058 B1 * 8/2001 Rajagopalan et al. ..... 216/67
6,281,116 B1 8/2001 Yanagida
6,283,130 B1 9/2001 Tamura
6,300,223 B1 10/2001 Chang et al.
6,322,714 B1 11/2001 Nallan et al.
6,476,488 B1 11/2002 Jeng et al.
6,527,968 B1 3/2003 Wang et al.
6,841,008 B1 * 1/2005 Branco et al. ..... 134/26
6,843,858 B2 1/2005 Rossman
6,852,242 B2 2/2005 Sun et al.
6,872,322 B1 3/2005 Chow et al.
6,900,133 B2 5/2005 Chinn et al.
6,933,243 B2 8/2005 Shen et al.
7,309,448 B2 12/2007 Chae et al.
7,628,897 B2 12/2009 Mungekar et al.
2001/0008138 A1 * 7/2001 Demos et al. ..... 134/1.1
2002/0072016 A1 6/2002 Chen et al.
2002/0117472 A1 8/2002 Sun et al.
2003/0045098 A1 3/2003 Verhaverbeke et al.
2003/0045131 A1 3/2003 Verbeke et al.
2003/0148622 A1 8/2003 Shen et al.
2003/0183244 A1 10/2003 Rossman
2004/0079728 A1 4/2004 Mungekar et al.
2004/0152331 A1 8/2004 Xu et al.
2007/0207275 A1 9/2007 Nowak et al.
2007/0238254 A1 10/2007 Ordonio
2008/0092806 A1 * 4/2008 West et al. ..... 118/70
2008/0146034 A1 6/2008 Shen et al.
2008/0153271 A1 6/2008 Foad et al.
2008/0194111 A1 8/2008 Delgadino et al.
2009/0032880 A1 2/2009 Kawaguchi et al.

FOREIGN PATENT DOCUMENTS

EP 0200951 12/1986
EP 0272143 6/1988
EP 0314990 5/1989
EP 0463373 1/1992
EP 0516043 12/1992
EP 0555546 8/1993
EP 0697467 2/1994
EP 0709877 5/1996
EP 0746015 12/1996
EP 0790635 2/1997
EP 0837497 4/1998
JP 4056770 2/1982
JP 59142839 8/1984
JP 60059739 4/1985
JP 62040728 8/1985
JP 6240728 2/1987

| | | |
|---|---|---|
| JP | 63005532 | 1/1988 |
| JP | 6303578 | 2/1988 |
| JP | 63089684 | 4/1988 |
| JP | 1050427 | 2/1989 |
| JP | 1064326 | 3/1989 |
| JP | 1253238 | 10/1989 |
| JP | 3170678 | 7/1991 |
| JP | 4165075 | 6/1992 |
| JP | 4214873 | 8/1992 |
| JP | 6025859 | 2/1994 |
| JP | 6177092 | 6/1994 |
| JP | 7029879 | 1/1995 |
| JP | 7326605 | 12/1995 |
| JP | 8031752 | 2/1996 |
| JP | 9036085 | 2/1997 |
| JP | 9129596 | 5/1997 |
| JP | 9249975 | 9/1997 |
| JP | 9320963 | 12/1997 |
| JP | 1054274 | 2/1998 |
| JP | 1023387 | 9/1998 |
| JP | 11345802 | 12/1999 |
| WO | WO-9615545 | 5/1996 |
| WO | 9906610 | 2/1999 |
| WO | 9920812 | 4/1999 |
| WO | 0108209 | 2/2001 |
| WO | 0188966 | 11/2001 |
| WO | 0249078 | 6/2002 |
| WO | 02068712 | 9/2002 |
| WO | 2007097822 | 8/2007 |
| WO | 2008076812 | 6/2008 |
| WO | 2008077020 | 6/2008 |

OTHER PUBLICATIONS

PCT International Preliminary Exam Report dated Feb. 14, 2000 PCT/US98/21865.

PCT International Search Report dated Jun. 22, 2001, European Patent Office, P.B. 5818 Patentlaan 2, NL-2280 HV Rijswijk.

PCT Search Report dated Oct. 28 1999 PCT/US99/14922.

Zaleski, et al., "Tungsten Silicide/Polsilicon Stack Etching using Mixed Fluorine-Chlorine Chemistry in a High Density Plasma Chamber", Proceedings of the International Symposium on Plasma Processing, May 3, 1998.

* cited by examiner

CLEANING PROCESS RESIDUES FROM SUBSTRATE PROCESSING CHAMBER COMPONENTS

BACKGROUND

Embodiments of the present invention relate to repairing surface defects in, and cleaning residues off, surfaces of a component exposed to plasma processes.

In the manufacture of integrated circuits and displays, semiconductor, dielectric and conductor materials are formed on a substrate and etched to form patterns of active and passive features. These materials are typically formed by plasma processes which use an energized gas, such as chemical vapor deposition (CVD), physical vapor deposition (PVD), ion implantation processes, and etching processes. In CVD processes, a reactive gas is used to deposit a layer of material on the substrate; and in PVD processes, a target is sputtered to deposit material on the substrate. In ion implantation processes, ions are implanted into the substrate to dope semiconducting material to form features having altered electronic properties. In etching processes, a patterned etch-resistant mask of photoresist and/or a hard mask is formed on the substrate by photolithographic methods, and the exposed portions of the substrate are etched by an energized gas.

The energized gas for the plasma can be energized by electrical energy, microwaves, or other energy carriers. When an energized gas is used to etch or deposit material on a substrate in a chamber, process residues often form on the surfaces of components in the substrate processing chamber. Accumulated process residues can flake off from chamber surfaces and fall upon and contaminate the substrate while it is being processed. Certain process residues can also corrode the component surfaces, requiring their frequent replacement. Accumulated process residues formed during one process, can also react with the process gases or residues formed in another process, preventing different processes from being run in the same chamber for mixed application productions.

Conventional chamber cleaning processes, which are periodically performed to clean process residues off interior chamber surfaces, often fail to properly clean off the residues. In wet cleaning processes, an operator manually scrubs down chamber surfaces with a residue dissolving solvent to clean the chamber surfaces. However, the day-to-day variability in such processes can affect the quality, and reproducibility, of cleaning. Also, the wet cleaning scrubbing material or solvent can contaminate the chamber. Instead of scrubbing the component surfaces with an abrasive scrubber, which often scratches the surfaces of the components with uneven gouges, the components can also be bead blasted to clean process residues formed on the component surfaces and provide a textured surface. However, aggressive grit blasting can create deep pits and scratches in the surfaces of the chamber components. Also, chamber components having complex shapes and small dimensions are difficult to clean by bead blasting as the grit blasting nozzle cannot be easily maneuvered around these complex shapes.

In plasma or dry cleaning processes, a cleaning gas energized by RF or microwave energy is used to clean process residues formed in the chamber. This process allows cleaning of the chamber components in-situ so that the chamber does not have to be dismantled into its components. However, plasma cleaning processes often fail to effectively clean residues off certain components, such as for example, residues formed on the sidewalls of gas distribution holes of components such as a gas distributor showerhead. It is not known why these components are not properly cleaned by the plasma process, when other internal chamber surfaces, such as the surfaces of the chamber itself, are effectively cleaned by the same process. Improper cleaning could be occurring because the cleaning plasma is formed between the RF biased gas distributor and substrate support, and not within the holes of the gas distributor showerhead itself. Also, the distal location of the exhaust port causes the plasma species to be rapidly drawn away from the holes of the gas distributor to limit exposure of residues formed in the holes of the showerhead to the cleaning gas plasma. As a result, conventional in-situ cleaning gas plasmas do not effectively clean the holes and internal surfaces of components such as the gas distributor showerhead.

Surface microcracks on ceramic surfaces of chamber components can also generate particles from cracked and flaked off surface grains. However, conventional surface repairing processes, which are used to repair micro-cracks on the surfaces of ceramic materials, are expensive and time-consuming processes. The ceramic component would need to be processed individually, so that it would have to be detached from any metallic component, before shipping to a surface repairing facility. Accordingly, most surface repairing processes are done only when the ceramic component is first manufactured. For example, the silicon containing grains at the micro-cracks of ceramic surfaces are converted to silicon oxide by an oxidation process, such as thermal oxidation. Thereafter, the converted silicon oxide is removed by dipping the component in a hydrofluoric acid bath. However, this surface repairing process involves a large amount of time not only because of the slow rate of oxidation, but also because the surface repairing process requires multi-step sequences of surface oxidation/oxide removal to heal micro-cracks well below the surface of the ceramic component. The conventional surface repairing process can take many days to complete.

Contaminant particles also arise from damaged micro-crack regions of the component surface, that are not fully healed in the heat treatment oxidization and acid bath cleaning process. Large numbers of contaminant particles also arise from damaged regions caused by abrasive and aggressive cleaning methods used to clean the surfaces of the ceramic materials. Conventional heat treatment oxidization processes are limited in their ability to repair micro-cracks in the surface of these cleaned components because there is a saturation point at which the ceramic materials such as a silicon carbide surface forms a passive layer of silicon dioxide. Further formation of silicon dioxide to heal the cracks is difficult. An acid (Hydrofluoric Acid) bath stripping process can also be used to remove excess silicon dioxide and expose fresh silicon carbide layers for additional oxidization treatment. However, the multi-step oxidization and acid bath process requires the dismantling the ceramic component from any attached metallic component. As a result, surface repairing takes even longer to complete and increases the costs.

Thus it is desirable to have a process for thoroughly cleaning process residues from components exposed to plasma processes. It is also desirable to clean component surfaces without excessive surface damage or scratches. It is further desirable to have a cleaning process that is cost effective and reproducible.

SUMMARY

A component of a substrate processing chamber is cleaned by removing the component from the chamber, the component having process residues on both internal and external surfaces. The component is placed in a cleaning chamber to face the open inlet of the chamber exhaust port, and exposed to an energized fluorinated cleaning gas comprising oxygen and a fluorinated gas while exhausting the cleaning gas from below the component so that the cleaning gas cleans off the residues on both the internal and external surfaces of the component.

A method of simultaneously cleaning and repairing surface defects of a component from a substrate processing chamber, also comprises removing the component from a substrate processing chamber, the component having process residues and surface defects on both internal and external surfaces. The process residues are cleaned off the component and surface defects repaired in a cleaning chamber which is a different chamber than the substrate processing chamber. The component is placed over an exhaust port in the cleaning chamber to face the open inlet of the exhaust port and exposed to an energized cleaning gas comprising oxygen and a fluorinated gas. The cleaning gas is exhausted from an exhaust port below the component such that the cleaning gas cleans off the process residues on both the internal and external surfaces of the component while repairing surface defects.

DRAWINGS

These features, aspects, and advantages of the present invention will become better understood with regard to the following description, appended claims, and accompanying drawings which illustrate exemplary features of the invention; however, it is to be understood that each of the features can be used in the invention in general, not merely in the context of the particular drawings, and the invention includes any combination of these features, where:

DESCRIPTION

Process residues on the surfaces of a component 50 from a substrate processing chamber can be effectively cleaned using the present process, the process being also useful for repairing surface defects on the component 50. The process residues accumulate on chamber components 50 after processing of several or a batch of substrates. The residues can comprise a hard polymeric material that includes carbon, silicon and other materials that are vaporized and condense during substrate processing. Plasma process residues can be especially hard to remove because the plasma environment in the substrate processing chamber can cause a chemical reaction to occur between the deposited residues on the component surface and the energized gas species. The process residues react with the component surface material to make the residues impervious to further abrasive cleaning. The chamber component 50 can be any one of the components of a substrate processing chamber, such as for example, but not limited to, a gas distributor plate, gas distributor nozzle, substrate support, antenna coil, liner, deposition ring, cover ring, shadow ring, chamber sidewall, or chamber lid.

Figure 1A:
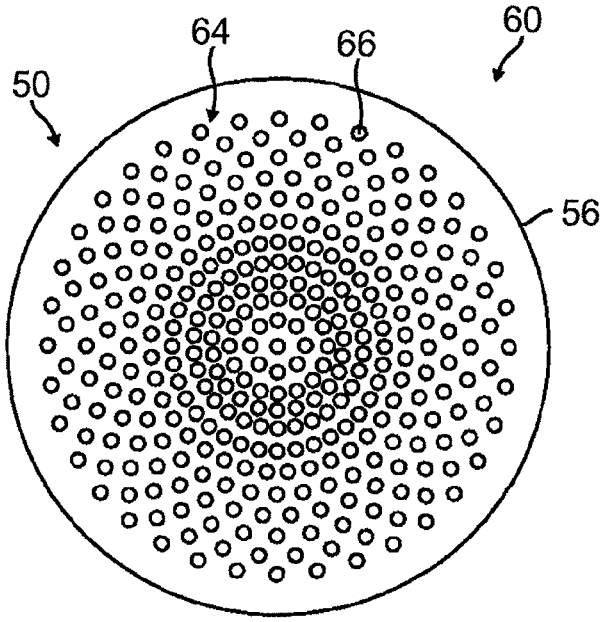
FIGS. 1A and 1B are a top view and a sectional side view of an embodiment of a gas distributor plate used in the processing of a substrate.
Figure 1B:
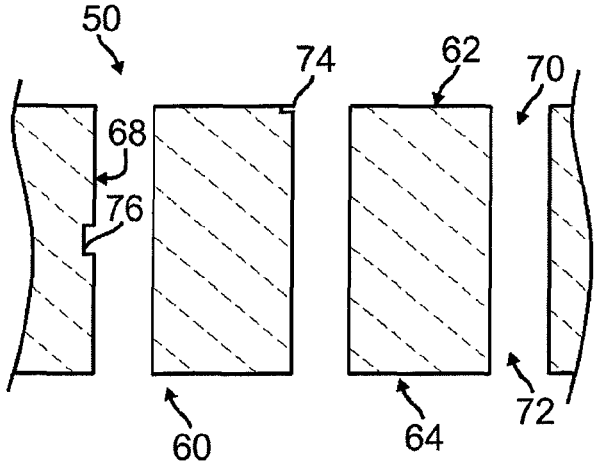

A chamber component 50 which has process residues on both their internal and external surfaces, the external surfaces being those which are exposed to the plasma in the chamber, are particularly difficult to clean. For example, a chamber component 50, such as gas distributor 56 comprising a showerhead 60 for distributing gas in a substrate processing chamber, comprises a plurality of gas holes 66, as shown in FIGS. 1A and 1B. The gas holes 66 are arranged in a spaced apart distribution for distributing process gas across the substrate surface. However, the many small-sized holes 66 often develop hard process residues on the sidewalls 68 of the holes. Residues also accumulate on both the internal and external surfaces 62, 64, respectively, of the showerhead 60, the internal surface 62 being enclosed and facing the gas inlet of the chamber, and the external surface 64 being exposed to the plasma process zone in the chamber, as shown for example in FIG. 7. In one version the showerhead 60 can be made from a ceramic such as, for example, aluminum nitride, aluminum oxide or silicon oxide, and fabricated by forming a powder of the desired compound, shaping a preform having a predetermined shape from the ceramic powder, pressing and/or sintering the preform to form a plate and machining the plurality of holes 66 therethrough. The holes 66 of the showerhead 60 are machined into the ceramic preform. In one version, the showerhead 60 includes from about 100 to about 1000 holes, that each have a diameter of from about 1 mm and about 3 mm. Each hole 66 comprises an upper rim 70 at a top surface of the gas distributor, a lower rim 72 at a bottom surface of the gas distributor and a sidewall 68 that connects the upper and lower rim through the body of the gas distributor. The machining process to form the holes often results in chamfers 74 along the upper and lower rims 70, 72 and can result in microcracks 76 in the sidewall 68. The microcracking and chamfering comprise regions of granular ceramic material that is prone to eroding from the showerhead 60 and falling onto the substrate 22 during processing. Such showerhead components are especially difficult to clean using conventional cleaning processes.

Figure 2:
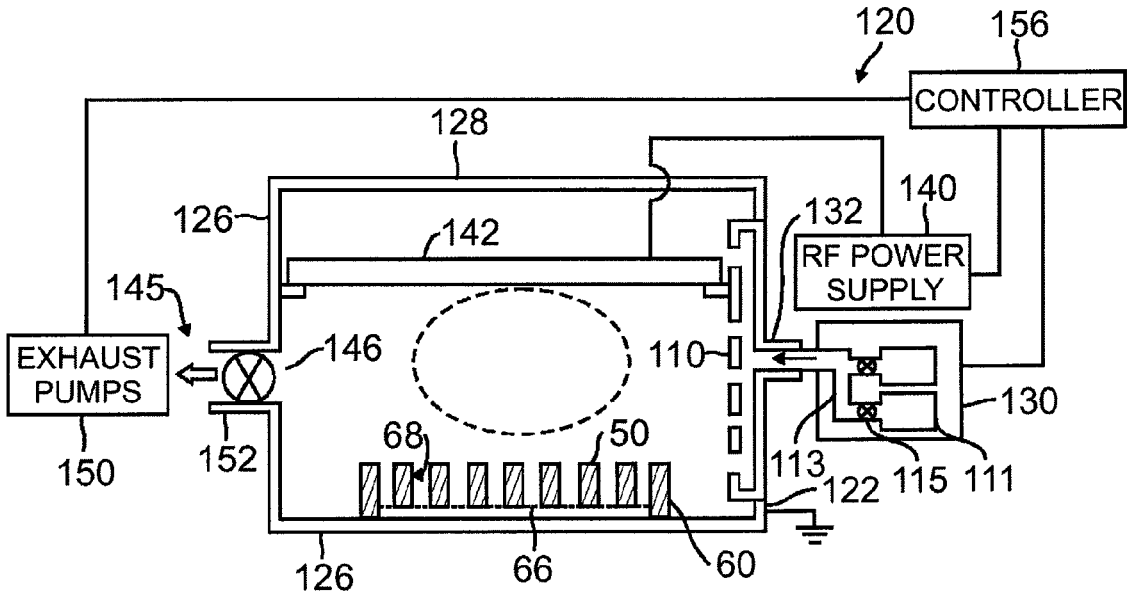
FIG. 2 is a sectional schematic side view of an embodiment of a cleaning chamber with horizontal gas feed-through in which a cleaning process can be performed to clean a chamber component.

To clean the chamber component 50, such as the gas distributor 56, the component 50 is removed from the substrate processing chamber for cleaning after a set number of substrate processing cycles are conducted in the substrate processing chamber or after a set period of plasma operational time in the chamber. The removed chamber component 50 is transferred to a cleaning chamber 120 which is a different chamber than the processing chamber. An illustrative embodiment of a cleaning chamber 120, as shown in FIG. 2, comprises enclosing walls 122 fabricated from aluminum, stainless steel, or anodized aluminum, and which include a sidewall 124, bottom wall 126, and ceiling 128. The illustrative cleaning chambers 120 and processes described herein are provided only to illustrate examples of the present process and chamber environment, and should not be used to limit its scope to the exemplary embodiments provided herein.

The removed chamber component 50 is placed in the cleaning chamber 120. The cleaning chamber 120 comprises a cleaning gas distributor 110 which receives, and distributes into the chamber, cleaning gas from a cleaning gas supply 130. Typically, the cleaning gas distributor 110 is made from the same material as the chamber walls such as, for example, aluminum, stainless steel or anodized aluminum. The cleaning gas supply 130 which may include one or more gas canisters 111 or sources of pressurized gases, and can include a gas mixing manifold 113, or the gas can be passed directed directly through a conduit 132 to the cleaning gas distributor 110. Various flow control valves 115 in the gas pathway control the flow of the different gases that form the cleaning gas.

Figure 3:
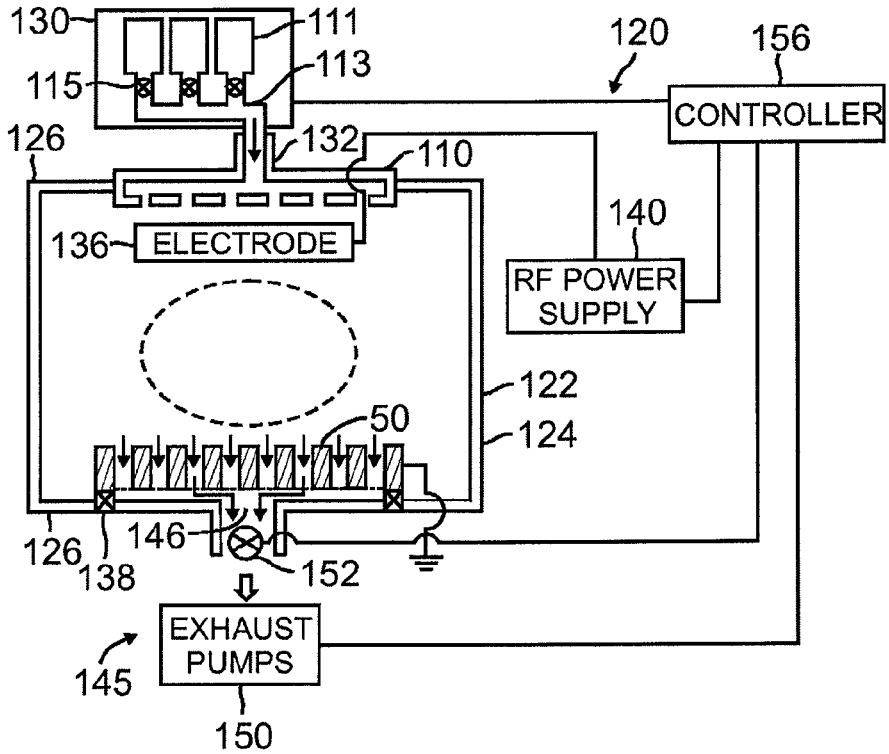
FIG. 3 is a sectional schematic side view of an embodiment of a cleaning chamber with vertical gas feed-through in which a cleaning process can be performed to clean a chamber component.

A gas energizer is also provided in the cleaning chamber 120 to energize the cleaning gas. In one version, the gas energizer may also or alternatively comprises a pair of process electrodes which are biased relative to one another. One of the process electrodes can be the gas distributor or an electrode plate 136 (as shown in FIG. 3) and the other can be the support 138 below the component 50 to be cleaned. An RF power supply 140 provides electrical power to the electrode 136 and support 138 to electrically bias them relative to one another, to capacitively couple electrical power to the cleaning gas in the cleaning chamber 120. In another embodiment, as shown for example in FIG. 2, the chamber 120 comprises one or more shelves 142 which serve as process electrodes 136. That is, each shelf can be powered with an RF power supply 140, grounded, or held at a floating potential. In one embodiment, a wall 122 of the chamber 120 is supplied with a ground potential, and a shelf 142 in the chamber 120 is powered with an alternating voltage. The shelf 142 and the chamber wall 122 serve as process electrodes 136 and can couple electrical power to the cleaning gas in a region of the chamber 120 that is between the shelf 142 and the chamber wall 122. In one embodiment, cleaning chamber 120 can be a part of a cleaning system such as, for example, an SCE Aluminum Chamber Plasma System, available from Anatech, Hayward, Calif., U.S.A.

The cleaning chamber 120 also has an exhaust system 145 to exhaust spent cleaning gas and byproducts from the chamber 120. The exhaust system 145 typically comprises an exhaust port 146 that is connected to an exhaust pump 150, and a throttle valve 152 in the exhaust port that can be used to control the pressure of the cleaning gas in the chamber 120. In one version the exhaust port is located under the chamber component 50 to be cleaned. Locating the exhaust port 152 under the component 50 allows the cleaning gas plasma species to be sucked past the component 50 and through holes in the component 50, providing much better cleaning of the interior surfaces of the component 50. The exhaust pumps 150 can include mechanical pumps such as roughing and turbomolecular pumps and non-mechanical pumps such as diffusion pumps.

In one version, the removed chamber component 50 is placed on a support 138 in a cleaning chamber 120 which rests on the bottom wall 116. The support 138 is typically a metal or ceramic structure designed to support the shape of one or more chamber components 50. For example, a suitable support 138 to hold a chamber component 50 that is a gas distributor showerhead 60 comprises a set of ceramic standoffs. The support 138 is designed so as not to impede the flow of energized cleaning gas species through the holes 66 of the gas distributor showerhead 60. In one version, as shown for example in FIG. 3, the component support faces the cleaning gas distributor 110.

In another version, as shown in FIG. 3, the removed chamber component 50 is placed on a shelf 142 or on a bottom wall 126 in a cleaning chamber 120. The shelf 142 or bottom wall 126 can comprise a metal or a ceramic and in one version comprises a planar aluminum surface. The supporting shelf 142 or bottom wall 126 can be part of the gas energizer, for example the supporting shelf can be powered with an RF power supply 140 to act as an electrode or can be connected to a ground potential. In one version, the chamber component 50 is placed on the bottom wall 126, which is connected to ground, and a shelf 142 above the component 50 is RF biased.

The cleaning processes may be performed in the cleaning chamber 120 by operating the chamber with a controller 156 comprising a computer having a central processor unit (CPU), that is coupled to a hardware interface, memory and peripheral computer components. In one version the controller 156 comprises a computer-readable program that may be stored in the memory. The computer readable program generally comprises process control software comprising program code to operate the cleaning chamber 120 and its components and can additionally comprise safety systems software, and other control software.

The computer readable program includes process selector program code to control the cleaning gas composition and flow rates, gas pressure, temperature, RF power levels, and other parameters of a particular cleaning process. The program code can also contain computer software to monitor the cleaning process. The process sets are predetermined groups of process parameters necessary to carry out specified processes. The cleaning process parameters are process conditions, including without limitations, gas composition, gas flow rates, temperature, pressure, and gas energizer settings such as RF power levels.

Figure 4:
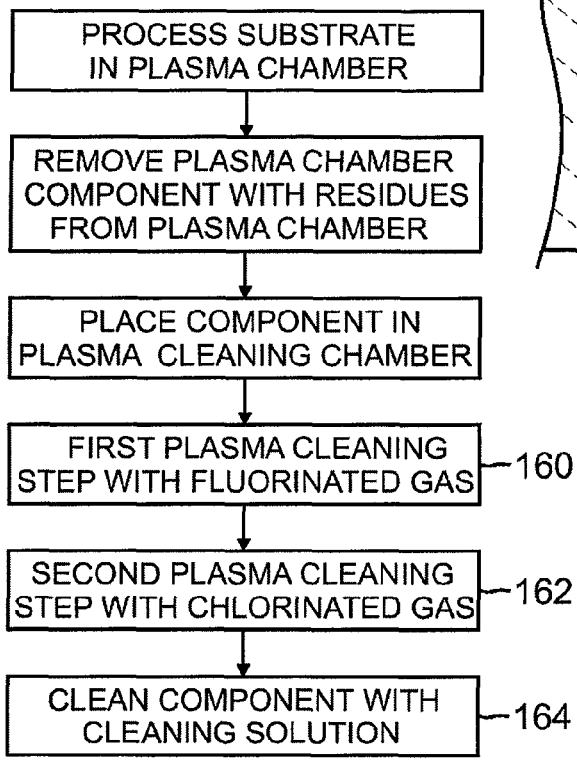
FIG. 4 is a flowchart showing an embodiment of a cleaning process comprising optional steps for cleaning process residues from the internal and external surfaces of the chamber component.

The process residues on the chamber component 50 are cleaned in the cleaning chamber 120 using an energized plasma cleaning process. FIG. 4 is a flowchart showing an embodiment of a cleaning process comprising optional steps for cleaning process residues from the internal and external surfaces of the chamber component 50. In one version, a cleaning gas comprising an oxygen-containing gas is introduced into the cleaning chamber 120. The oxygen forms energized gas species which cleans or etches away residues comprising carbon-containing species. The oxygen-containing cleaning gas effectively cleans organic (carbon-containing) residues from the surfaces of the chamber component 50 by forming volatile carbon-containing species or carbon-oxygen species, such as carbon dioxide and carbon monoxide. While the oxygen plasma does not effectively clean other components of the process residues, such as arsenic species and compounds, or even silicon and its compounds; the oxygen-containing gas desirably oxidizes certain residue components and even the surface of the component itself. For example, materials such as silicon carbide (SiC) or silicon nitride (SiN) in the process residues, are oxidized to form silicon dioxide ($SiO_2$) while releasing carbon and nitrogen species. The oxidized silicon compounds can be cleaned more easily than the SiC or SIN compounds. In one version, the cleaning gas comprises oxygen provided in a volumetric flow rate of from about 50 to about 200 sccm.

In one version, the cleaning gas additionally comprises a fluorinated gas which is contains a high molecular fraction of elemental fluorine ($F^-$) and may also contain other elements. For example, suitable fluorinated gases include $NF_3$, $CF_4$ and $SF_6$. These gases have a high ratio of fluorine to other species and can provide a relatively large quantity of dissociated or ionized fluorine species in the energized gas. The fluorinated gas is ionized to form atomic fluorine and fluorine-containing species that remove process residues containing silicon-containing material on the internal and exterior surfaces of the chamber component 50. The fluorine-containing species also causes less erosive damage to the surfaces of the component 50 compared to conventional plasma cleaning processes. A preferred fluorinated gas comprises $CF_4$, which provides good cleaning of the process residues on the surfaces of the chamber component 50, especially residues containing oxide species such as silicon dioxide. For example, fluorine species can react with silicon dioxide ($SiO_2$) to form silicon tetrafluoride ($SiF_4$) and molecular oxygen ($O_2$), which evaporate away. A suitable volumetric flow ratio of oxygen to fluorinated gas is from about 1:1 to about 4:1. A balanced volumetric flow ratio is desirable so that the energized oxygen and fluorine are available in sufficient concentration to obtain a good cleaning rate and can even be selected in relation to the chemical composition of the residue in order to provide an optimal cleaning rate.

In one version the cleaning gas is supplemented with a diluent gas. The diluent gas enhances the cleaning gas plasma by providing energetic neutrals and species which activate or stabilize the plasma. Suitable diluent gases include, for example, nitrogen, argon, helium, hydrogen and carbon monoxide; of which argon and helium are preferred. Generally the volumetric flow ratio of fluorinated gas to diluent gas is from about 2:1 to about 5:1. This ratio provides a good balance between cleaning rates, cleaning uniformity, and plasma stability.

The cleaning gas is energized in the cleaning chamber 120 to form an energized cleaning gas which is exposed to the chamber component 50. In one embodiment, the cleaning gas is energized by RF energy supplied by the RF power supply 140 which biases an electrode in the chamber 120 relative to a support on which the component 50 rests. The RF energy can be provided at a frequency of 13.6 MHz and at a bias power level of from about 100 to about 1100 watts and in one version is provided with a power level of from about 150 to about 650 watts. As one example, the pressure in the chamber 120 is maintained at from about 100 mT to about 1000 mT and the cleaning gas is energized for about 1500 to about 3000 seconds. Cleaning gas and process byproducts are exhausted from the chamber 120 by the exhaust pumps 150.

When the first cleaning process is used to clean a chamber component comprising silicon carbide with micro-cracked surface, the cleaning processes can simultaneously oxidize fresh silicon carbide layers and remove silicon dioxide layers that would otherwise saturate the surface as a passive layer of silicon oxide. Removal of the silicon dioxide residues exposes fresh silicon carbide layers which can then be further oxidized and treated to heal the microcracks in the surface.

If the component 50 is not entirely cleaned by the first plasma cleaning process 160, a second plasma cleaning process 162 can be performed to remove remaining or more adherent residues from the surfaces of the chamber component 50. In one version the composition of the cleaning gas used in the first plasma cleaning process is different from the composition of the cleaning gas used in the second plasma cleaning process. By changing the composition of the cleaning gas, the first and second cleaning processes 160,162 are optimized to enhance cleaning of the chamber component 50. For example, in a first cleaning process 160, the fluorinated cleaning gas comprises oxygen and a fluorinated gas that is selected to aggressively clean process residues, and in the second cleaning process 162, the chlorine-containing cleaning gas can comprise a chlorine-containing gas that is selected to clean any remaining process residues, as well as to remove any cleaning residues generated by the fluorinated cleaning gas. In this manner, the cleaning process can be optimized to not only clean process residue generated in previous substrate processing steps, but also to clean any cleaning residues that might be generated during the cleaning process itself.

In this second plasma cleaning process 162, the chamber component 50 is exposed to an energized chlorine-containing cleaning gas. The chlorine-containing gas contains elemental chlorine ($Cl^-$) and may also contain other elements. It is believed that the chlorine-containing gas serves as the primary etchant for removing residues containing non-volatile fluorides. The chlorine-containing gas ionizes to form atomic chlorine and chlorine-containing species that remove silicon-containing material. For example, silicon-containing residues are etched by chlorine-containing ions and neutrals to form volatile $SiCl_x$ species that are exhausted from the chamber 120. The chlorine-containing gas can comprise $Cl_2$, or other chlorine-containing gases that are equivalent to chlorine, for example, HCl, $BCl_3$, $CCl_4$, and mixtures thereof.

The chlorine-containing cleaning gas can also include oxygen which serves the same function as before. A suitable first volumetric flow ratio of chlorine-containing gas to oxygen in a chlorine-containing cleaning gas comprising $Cl_2$ to $O_2$ is, for example, from about 0.1:1 to about 1:1, and even from about 0.2:1 to about 0.8:1.

The chlorine-containing cleaning gas can also include a diluent gas, which serves to enhances the cleaning gas plasma by providing energetic neutrals and species which activate or stabilize the plasma. The diluent gas can comprise, for example, nitrogen, argon, helium, hydrogen and carbon monoxide and in one version comprises argon.

The second cleaning process gas is also energized by RF energy supplied by the RF power supply 136 to form an energized chlorine-containing cleaning gas that cleans the process residues on the components surfaces. The RF energy can be provided at a frequency of 13.6 MHz and at a bias power level of from about 100 to about 1000 watts. The chlorine-containing cleaning gas is maintained at a pressure of from about 50 to about 300 and is energized for about 30 to about 200 seconds. Upon completion of the cleaning process 162, the chlorine-containing cleaning gas is exhausted from the chamber 120 by the exhaust pumps 150.

The energized cleaning gas cleans the residues by reacting with the residues on the surfaces in the chamber 120 and forming volatile compounds and species, which are exhausted from the chamber 120. For example, reactive chlorine-containing species can react with residues comprising aluminum, titanium and titanium nitride to form volatile products such as $AlCl_3$ and $TiCl_4$ that are exhausted from the chamber 120. Reactive oxygen-containing species can remove residues comprising carbon-containing compounds by reacting with the carbon-containing compounds to form gaseous carbon monoxide and carbon dioxide species.

However, even the second cleaning process 162 can sometimes fail to completely clean off all the process residues from the surfaces of the chamber component 50. It has been determined that cleaning with the energized chlorine-containing cleaning gas may sometimes even generate other types or compositions of cleaning residues that deposit on surfaces in the chamber 120. For example, a cleaning step with a cleaning gas comprising $Cl_2$ and $O_2$ may leave cleaning residues such as metal and/or chlorine-containing salts and oxides on surfaces in the chamber 120. These cleaning residues can be detrimental to subsequent processes performed in the chamber 120.

Thus, in yet another process variant, the cleaning of plasma residues of the chamber components 50 is further improved by cleaning the components 50 by wiping them with a cleaning solvent after the component 50 is removed from the cleaning chamber 120. A suitable cleaning solvent comprises isopropanol. The cleaning solvent is applied on a wipe, such as a scrub pad, and wiped across the surfaces of the chamber component 50. The solvent cleaning step 164 with isopropanol cleans off persistent polymers which do not readily produce volatile plasma etch byproducts.

Unexpectedly and surprisingly, the above cleaning methods were found to substantially reduced the amount of particulate matter dropped from the treated chamber component 50 during subsequent use of the component in a substrate processing chamber. It is believed that this reduction in particulate contaminant is because the plasma cleaning process also repairs surface damage such as microcracks 76 and rough chamfers 74 on the internal and external surfaces of the chamber component 50. It is believed that this surface repair occurs through chemical and physical erosion of the surface by the plasma. For example, the sharp edges of the microcracks 76 have higher free energy and are more easily eroded by plasma bombardment. The plasma bombards the surface and rounds off the sharp corners, knocking off portions of the surface that are most likely to fall off and land on a substrate as a particle adder during a substrate treatment process. In one embodiment, the surface of the component 50 is processed for a sufficient time to reduce the plasma particle adder count by from about 1500 to about 5. Rounding off the edges of the microcracks 76 also reduces crack propagation and increases the fracture resistance of the component 50.

In amorphous or glassy materials, the plasma surface repair is performed in part by plasma annealing as the plasma bombards and transfers thermal energy to the surface of the component 50. For example, the micro-crack healing process can be enhanced because atomic forces acting across the tips of the microcracks 76 tend to pull crack surfaces back into contact across the entire microcrack plane. In microcrystalline materials, the grain boundary regions often contain small amounts of impurities that act as fluxing agents causing more rapid fluxing and resultant healing of the microcrack surfaces. The heat energy supplied to the surface by the plasma causes softening and fluxing of the localized heated region causing the microcracks 76 to close and seal themselves off. In one embodiment the plasma surface repair is performed for a sufficient time to essentially partially or entirely heal the microcracked surface.

Some portions of the chamber components 50 are prone to fracture during use, for example, regions that are more readily subject to abrasion and grinding from applied external forces during the handling or manufacture of the component 50. The localized surface regions can also include those regions of the component 50 which are more susceptible to applied stresses during handling and use. For example, the edges of the quartz rings used in substrate processing chambers are often chipped or cracked when the ring is removed for cleaning or replacing after use for a predetermined number of process cycles. The edges, which may also include corners, are often easily cracked or chipped in use. Thus, increasing the fracture strength of the chamber components can significantly increase their process lifetime.

Other components can have excessive microcracks 76 that result from fabrication. For example, the showerhead 60 gas distributor component has many fine holes 66 drilled through it's thickness during fabrication and the upper and lower rims 70,72 of the holes 66 are often chamfered. The holes 66 of a gas distributor showerhead 60 can have a diameter of from 1 mm to about 3 mm which makes them difficult or even impossible to sand, polish or bead blast. Moreover, these processes can even cause pitting and damage of the small features.

It is believed that the large number of contaminant particles formed from the cleaned chamber component in the substrate processing chamber is a result of the surface defects present in the chamber component. A chamber component particularly sensitive to such surface damage is the gas distributor showerhead, especially when the gas distributor component is made from a ceramic material, such as silicon carbide and aluminum nitride, which has micro-cracks arising from the ceramic manufacturing process. Extensive micro-cracks on the surface of the gas distributor showerhead or other component surface can result in the generation of contaminant particles when the surface is exposed to a plasma process, because the plasma preferentially erodes away the microcrack region. Thus in addition to cleaning residues from the chamber component surfaces, the present cleaning process was found to advantageously repair surface defects and damage caused to the surfaces of the chamber components by their exposure to energetic or corrosive gases used to process a substrate.

The following examples illustrate embodiments of the present process and results obtained from these processes, however, other processes are possible as would be apparent to those of ordinary skill in the art; accordingly, these illustrative examples should not be used to limit the scope of the invention.

Example 1

Figure 5:
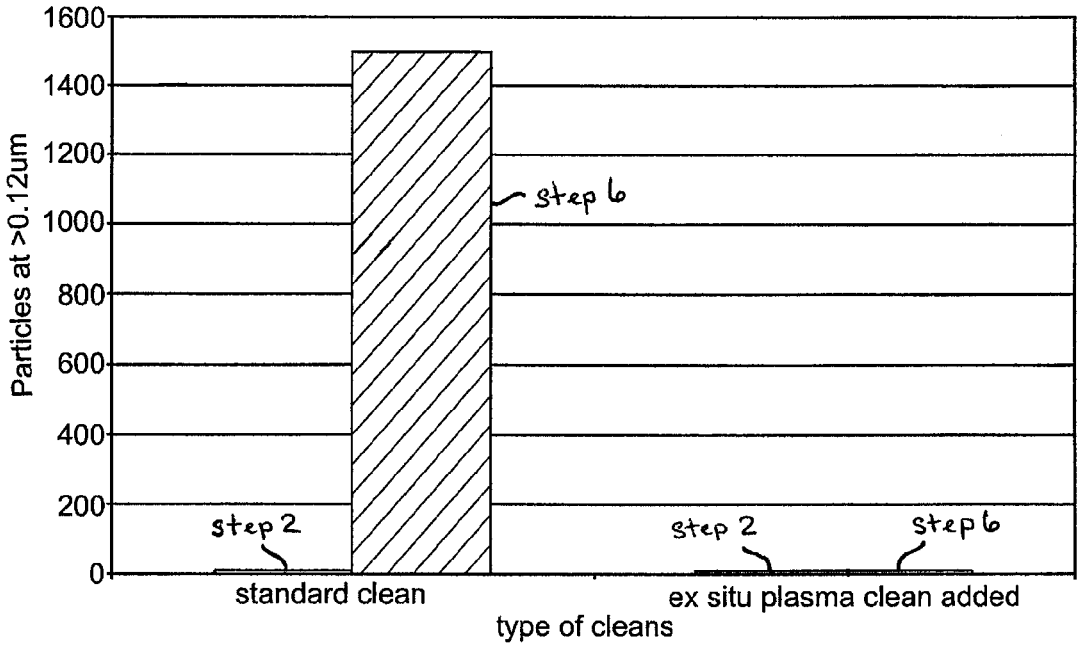
FIG. 5 is a bar graph of particulate adders for showerhead chamber components that have been treated using different cleaning processes.

The particle contaminant counts from a showerhead treated by the above disclosed treatment method is shown in FIG. 5. For comparison, particle contaminant counts from a showerhead treated only with a standard clean method is also shown.

Particle contaminant counts were taken at steps 2 and 6 of a six-step particle check protocol. The particle check protocol is performed to verify that the chamber particulate contaminant counts are at an acceptable level prior to use in the processing of substrates. In a first step, the showerhead is installed in the chamber. In step 2, showerhead particle contaminant levels are checked for gas-only particles by flowing the process gas mixture through the showerhead without plasma excitation. A particle count is taken of particles that fall onto a test wafer and have a size from about 0.12 microns in diameter and larger. In step 3, six season wafers are processed using an excited plasma gas. In step 4, contaminant levels are again checked for gas-only particles. In step 5, 24 wafers are processed using an excited plasma gas, to further season the process chamber. Finally, in step 6, the contaminant level is once again checked for gas-only particles.

In a standard clean process, the showerhead is bead blasted and then rinsed with water. A showerhead cleaned only with this standard clean process was subjected to a particle check protocol. The data of FIG. 5 shows contaminant particle counts of about 5 per wafer at step 2 and about 1500 per wafer at step 6.

A second showerhead was cleaned first with a standard clean process and then with a plasma cleaning process according to the above disclosed treatment methods. The process gas was provided in a composition of $O_2$, $CF_4$ and Ar in flow rates of about 70, 40, and 20 sccm and the chamber was maintained at a pressure of about 300 mT. An RF power of about 500 W was applied to the gas energizer for about 1875 seconds to energize the process gas and clean the showerhead. The data of FIG. 5 shows contaminant particle counts of the second showerhead of about 5 per wafer at both steps 2 and 6.

Example 2

Figure 6:
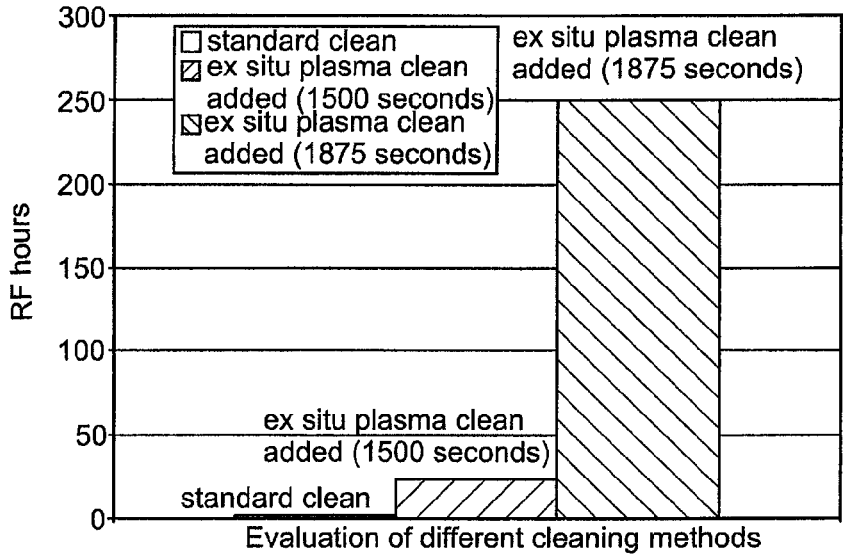
FIG. 6 is a bar graph of lifespan for a showerhead chamber components that have been treated using different cleaning processes.

It is believed that healing of the surface microcracks of the chamber components substantially increases hardness and fracture stress of the treated material because the lifespan of some of the showerhead chamber components treated by the above methods were found to be substantially higher than the lifespan of showerhead chamber components treated by conventional methods, as shown in FIG. 6. A first showerhead treated with only a standard clean process fails after approximately one hour of RF plasma use. A second showerhead treated with a standard clean process followed by a plasma clean process wherein power was applied to the gas energizer for about 1500 seconds to energize the process gas and clean the showerhead, first fails after about 24 hours of RF plasma use. A third showerhead treated with a standard clean process followed by a plasma clean process wherein power was applied to the gas energizer for about 1875 seconds to energize the cleaning gas and clean the showerhead, first fails after about 250 hours of use.

Thus the present cleaning process and its variants provide significantly improved cleaning of plasma chamber components 50. The present cleaning process can be used to clean the process residues quickly, as compared to conventional cleaning processes. Moreover, the present cleaning process enables a chamber component 50 to undergo simultaneous cleaning and surface repair, extending the lifespan of the component 50.

Example 3

An embodiment of a substrate processing chamber 20 capable of processing a substrate 22, such as semiconductor substrates, with energized gases to form process residues on chamber component, such as the gas distributor 60, will now be described with reference to FIG. 7. The substrate processing chamber 20 comprises enclosure walls 24, which may comprise a ceiling 26, sidewalls 28, and a bottom wall 30 that enclose a process zone 32. The substrate processing chamber 20 can be used for example, in a CVD, PVD or even as an etching chamber. The chamber 20 contains a substrate support 34 comprising a pedestal 36 with a stem 40 connected to the underside of the pedestal 36, the stem 40 extending through the bottom wall 30 of the chamber 20, where it is connected to a drive system (not shown). The drive system is capable of moving the stem 40 upward and downward in the chamber 20 to mechanically position the pedestal 36 within the process zone 32. The pedestal 36 can include a heater to heat the substrate (not shown) to a desired process temperature. The substrate support 34 further comprises a process electrode 42 embedded in the support 34.

In operation, process gas is introduced into the chamber 20 through a gas delivery system 46. In one embodiment, the gas delivery system 46 has gas flow valves 48 on a gas feed line 50 that transports gases from a gas supply 52 to the gas distributor in the process zone 32. The gas distributor comprises a gas distributor 56, which can also serve as process electrode, having gas outlets 58, through which gas may exit the gas distributor into the process zone 32. In one version the gas distributor 56 comprises a showerhead 60 as described above. Spent process gas and process byproducts are exhausted from the chamber 20 through an exhaust 80 which may include an exhaust port 82 that receives spent process gas from the process zone 32 and delivers the gas to an exhaust conduit 84, a throttle valve 86 to control the pressure of process gas in the chamber 20, and one or more exhaust pumps 88.

The process gas is energized to process the substrate 22 by a gas energizer that couples energy to the process gas in the process zone 32 of the chamber 20. For example, the gas energizer may comprise process electrodes that may be electrically biased to energize the process gas. The process electrodes may include an electrode that is a wall, such as a sidewall 28 of the chamber 20, and which may be capacitively coupled to another electrode, such as the ceiling 26, gas distributor plate 56 or substrate support 34. The electrodes are biased by a DC voltage, a high frequency voltage, such as a radio frequency (RF) voltage, or a combination of both.

Alternatively or additionally, the gas energizer can also include an antenna 92 comprising an inductor coil 94 which has a circular symmetry about the center of the chamber 20. The inductor coil is supported by stand-offs that separate the coil from the chamber sidewall 28. In yet another version, the gas energizer may comprise a microwave source and waveguide to activate the process gas by microwave energy in a remote zone (not shown) upstream from the chamber. Additional inductor or electromagnetic coils 94 can also be located around the chamber 20, for example, above the ceiling 26 of the chamber or around the sidewalls 28.

Figure 7:
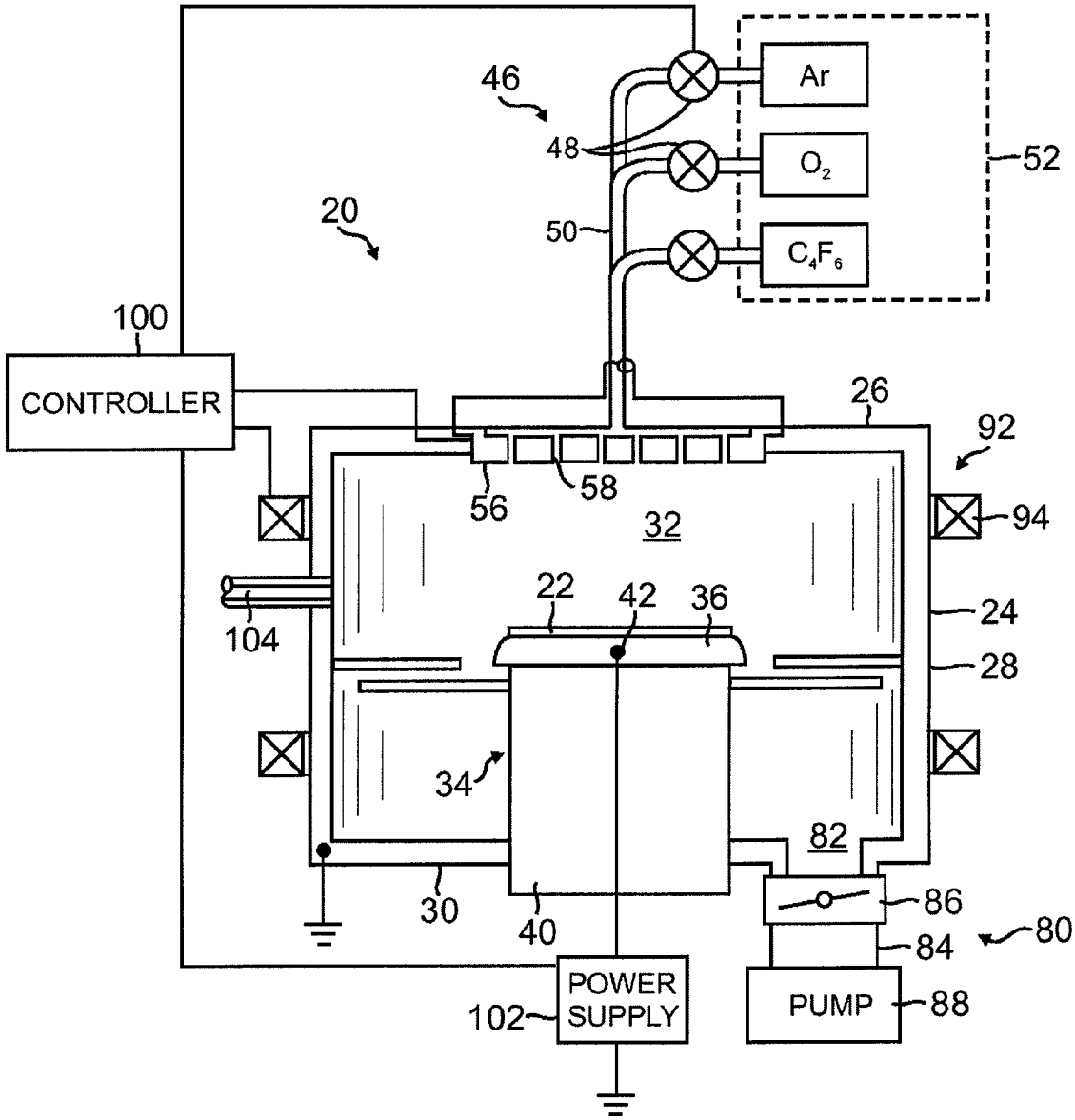
FIG. 7 is a sectional schematic side view of an embodiment of a substrate processing chamber used in the processing of a substrate.

In the chamber of FIG. 7, the gas provided into the process zone 32 is energized by coupling electromagnetic energy into the process zone 32 of the chamber 20. The gas is energized by providing an RF source power to an antenna 92 and an RF bias potential to the gas distributor plate 56 and electrodes to facilitate generation of an energized gas between the gas distributor 56 of the gas distributor and the pedestal 36. The power level of the RF bias current may be from about 500 to about 4500 Watts and the power level of the RF source current may be from about 10 to about 2000 Watts.

The chamber 20 can also comprise a remote plasma source to deliver an energized cleaning gas to the chamber (not shown). The energized cleaning gas may be provided into the chamber 20 to remove deposited material from the interior surfaces of the chamber after one or more substrate processing iterations. The remote plasma source may comprise a cleaning gas supply, a remote chamber, a gas energizer and gas transfer conduit. Control valves control the flow of cleaning gas through the conduit. The cleaning gas from the cleaning gas supply may be transferred by the conduit to the remote chamber where the cleaning gas may be energized by the gas energizer. The gas energizer couples electromagnetic energy, such as for example microwave energy, to the cleaning gas to form reactive species. Once activated, the cleaning gas is transferred by the gas transfer conduit from the remote chamber to a gas feed line. The gas feed line delivers the energized cleaning gas to the gas distributor in the process zone 32.

The chamber 20 is controlled by a controller 100 that comprises program code having instruction sets to operate components of the chamber 20 to process substrates 22 in the chamber 20. For example, the controller 100 can comprise a substrate positioning instruction set to operate one or more of the pedestal 36 and substrate transport to position a substrate 22 in the chamber 20 and to set a chucking voltage applied by the electrode power supply 102 to hold the substrate 22 onto the substrate support; a gas flow control instruction set to operate the flow control valves to set a flow of gas to the chamber 20; a gas pressure control instruction set to operate the exhaust throttle valve 86 to maintain a pressure in the chamber 20; a gas energizer control instruction set to operate the gas energizer to set a gas energizing power level; a temperature control instruction set to control temperatures in the chamber 20, for example by controlling the supply of heat transfer fluid supplied to a heat transfer plate (not shown), and the supply of heat transfer gas to the support receiving surface; and a process monitoring instruction set to monitor the process in the chamber 20, for example by monitoring temperatures via a thermocouple.

To process a substrate 22, the substrate processing chamber 20 is evacuated and maintained at a predetermined sub-atmospheric pressure. A substrate 22 is then provided on the substrate support by a substrate transport which operates a robot arm (not shown) that is passed through a slit 104 in the chamber sidewall 28, bearing a substrate 22. The gas distributor provides a process gas to the chamber 20 and the gas energizer couples energy to the process gas to energize the gas and process the substrate 22, for example, by etching material on the substrate.

Although exemplary embodiments of the present invention are shown and described, those of ordinary skill in the art may devise other embodiments which incorporate the present invention, and which are also within the scope of the present invention. For example, other cleaning processes may be performed without deviating from the scope of the present invention. Also, cleaning gas compositions other than those specifically mentioned may be used, as would be apparent to those of ordinary skill in the art. Furthermore, the terms below, above, bottom, top, up, down, first and second and other relative or positional terms are shown with respect to the exemplary embodiments in the figures and are interchangeable. Therefore, the appended claims should not be limited to the descriptions of the preferred versions, materials, or spatial arrangements described herein to illustrate the invention.

What is claimed is:

1. A method of cleaning a component of a substrate processing chamber, the component having both internal and external surfaces, and the method comprising:

(a) removing the component from the substrate processing chamber, the component having process residues on both the internal and external surfaces of the component;

(b) placing the component in a cleaning chamber having an exhaust port located under the component;

(c) exposing the component to an energized fluorinated cleaning gas comprising oxygen and a fluorinated gas; and (d) exhausting the energized fluorinated cleaning gas from under the component so that the energized fluorinated cleaning gas is sucked past the internal surfaces of the component to clean process residues on both the internal and external surfaces of the component.

2. A method according to claim 1 wherein the fluorinated gas comprises at least one of $CF_4$, $NF_3$ and $SF_6$.

3. A method according to claim 2 wherein the fluorinated cleaning gas is energized for about 1500 to about 3000 seconds.

4. A method according to claim 2 wherein the fluorinated cleaning gas is energized by RF energy at a bias power level of from about 100 to about 1100 watts.

5. A method according to claim 2 further comprising after step (d) performing the steps of:

(e) exposing the component to an energized chlorine-containing cleaning gas comprising a chlorine-containing gas; and (f) exhausting the energized chlorine-containing cleaning gas from under the component so that the energized chlorine-containing cleaning gas is sucked past the internal surfaces of the component to clean process residues on both the internal and external surfaces of the component.

6. A method according to claim 5 wherein the chlorine-containing gas comprises $Cl_2$.

7. A method according to claim 5 wherein the chlorine-containing cleaning gas comprises oxygen.

8. A method according to claim 7 wherein the chlorine-containing cleaning gas comprises argon.

9. A method according to claim 5 wherein the chlorine-containing cleaning gas is energized for about 30 to about 200 seconds.

10. A method according to claim 9 wherein the chlorine-containing cleaning gas is energized by RF energy at a bias power level of from about 100 to about 1000 watts.

11. A method according to claim 1 further comprising:

(g) wiping the one or more of the internal and external surfaces of the component with a cleaning solution comprising isopropanol.

12. A method of simultaneously cleaning and repairing surface defects of a component from a substrate processing chamber, the method comprising:

(a) removing a component from the substrate processing chamber, the component having process residues and surface defects on both internal and external surfaces of the component;

(b) cleaning the process residues off the component and repairing surface defects of the component in a cleaning chamber which is a different chamber than the substrate processing chamber, by:

(i) placing the component in the cleaning chamber over an exhaust port of the cleaning chamber;

(ii) exposing the component in the cleaning chamber to an energized cleaning gas comprising oxygen and a fluorinated gas; and (iii) exhausting the cleaning gas from the exhaust port under the component, so that the cleaning gas is sucked past the internal surfaces of the component to clean process residues on both the internal and external surfaces of the component while repairing the surface defects of the component.

13. A method according to claim 12 wherein the fluorinated gas comprises at least one of $CF_4$, $NF_3$ and $SF_6$.

14. A method according to claim 12 wherein the cleaning gas is energized for about 1500 to about 3000 seconds.

15. A method according to claim 12 wherein the cleaning gas is energized by RF energy at a bias power level of from about 100 to about 1100 watts.

16. A method according to claim 5 wherein the chlorine-containing gas comprises HCl, $BCl_3$, $CCl_4$, or mixtures thereof.

17. A method according to claim 1 comprising providing a flow of oxygen and a fluorinated gas wherein the flow comprises a volumetric flow ratio of oxygen to fluorinated gas of from about 1:1 to about 4:1.

18. A method according to claim 1 wherein the fluorinated cleaning gas comprises a diluent gas that is provided in a volumetric flow ratio of fluorinated gas to diluent gas of from about 2:1 to about 5:1.

19. A method according to claim 12 comprising providing a flow of oxygen and a fluorinated gas wherein the flow comprises a volumetric flow ratio of oxygen to fluorinated gas of from about 1:1 to about 4:1.

20. A method according to claim 12 wherein the cleaning gas comprises a diluent gas that is provided in a volumetric flow ratio of fluorinated gas to diluent gas of from about 2:1 to about 5:1.

21. A method according to claim 1 wherein the component comprises a gas distributor showerhead having holes and wherein (b) comprises placing the gas distributor showerhead so that the holes face the exhaust port to allow the fluorinated cleaning gas to pass through the holes.

22. A method according to claim 12 wherein the component comprises a gas distributor showerhead having holes and wherein (b)(i) comprises placing the gas distributor showerhead so that the holes face the exhaust port to allow the cleaning gas to pass through the holes.

23. A method of cleaning a component of a substrate processing chamber, the component comprising a plurality of holes having process residues therein, the method comprising:

(a) removing the component from the substrate processing chamber;

(b) placing the component in a cleaning chamber having an exhaust port such that the exhaust port is under the component;

(c) energizing a fluorinated cleaning gas comprising oxygen and a fluorinated gas in the cleaning chamber; and (d) exhausting the fluorinated cleaning gas from under the component so that the cleaning gas flows through the holes having the process residues therein to clean the process residues from the holes.

24. A method according to claim 23 wherein the holes comprise sidewalls and the process residues are cleaned off the sidewalls of the holes.

* * * * *